US006446410B1

(12) United States Patent
Hagel

(10) Patent No.: US 6,446,410 B1
(45) Date of Patent: Sep. 10, 2002

(54) COMPONENT WITH INTEGRAL ENVIRONMENT RESISTANT MEMBERS

(75) Inventor: Richard C. Hagel, Nacogdoches, TX (US)

(73) Assignee: Burns, Morris & Stewart Limited Partnership, Nacogdoches, TX (US)

( * ) Notice: Subject to any disclaimer, the term of this patent is extended or adjusted under 35 U.S.C. 154(b) by 0 days.

(21) Appl. No.: 09/621,590

(22) Filed: Jul. 21, 2000

Related U.S. Application Data

(63) Continuation of application No. 09/342,562, filed on Jun. 29, 1999, now Pat. No. 6,122,882, which is a continuation of application No. 09/130,160, filed on Aug. 6, 1998, now Pat. No. 5,950,391, which is a continuation of application No. 08/837,776, filed on Apr. 22, 1997, now Pat. No. 5,873,209, which is a continuation of application No. 08/612,757, filed on Mar. 8, 1996, now Pat. No. 5,661,943.

(51) Int. Cl.[7] ..... E04C 2/02

(52) U.S. Cl. ..... 52/717.01; 52/207; 52/309.13; 52/455; 52/514

(58) Field of Search ..... 52/656.4, 204.1, 52/210, 733.2, 309.1, 207, 311.1, 309.13, 455, 514, 717.01; 256/19, DIG. 5; D25/48

(56) References Cited

U.S. PATENT DOCUMENTS

| | | | | | |
|---|---|---|---|---|---|
| 3,812,621 | A | * | 5/1974 | Ragland | 49/505 |
| 4,068,433 | A | * | 1/1978 | Glover | 52/207 |
| 5,074,092 | A | * | 12/1991 | Norlander | 52/455 |
| 5,501,054 | A | * | 3/1996 | Soltis et al. | 52/730.7 |
| 5,649,397 | A | * | 7/1997 | Sauder | 52/211 |
| 5,775,041 | A | * | 7/1998 | Tull et al. | 52/455 |
| 6,122,882 | A | * | 9/2000 | Hagel | 52/656.4 |

* cited by examiner

*Primary Examiner*—Carl D. Friedman
*Assistant Examiner*—Jennifer I. Thissell
(74) *Attorney, Agent, or Firm*—Standley & Gilcrest LLP

(57) ABSTRACT

A construction component for improved moisture, decay and insect resistance. The component preferably includes a plurality of members of which certain portions are comprised of materials resistant to moisture, decay and insects. The resistant member(s) are integrally connected to wood portion(s) to provide a single, low cost structure.

4 Claims, 2 Drawing Sheets

COMPONENT WITH INTEGRAL ENVIRONMENT RESISTANT MEMBERS

This application is a continuation of U.S. patent application Ser. No. 09/342,562, filed Jun. 29, 1999 now U.S. Pat. No. 6,122,882, which is a continuation of Ser. No. 09/130,160, filed Aug. 6, 1998, now U.S. Pat. No. 5,950,391, which is a continuation of Ser. No. 08/837,776 filed Apr. 22, 1997, now U.S. Pat. No. 5,873,209, which is a continuation of U.S. patent application Ser. No. 08/612,757 filed Mar. 8, 1996, now U.S. Pat. No. 5,661,943 issued Sep. 2, 1997.

FIELD OF THE INVENTION

The invention relates to frames such as door or window frames, or other components such as porch posts, brickmolds, and casings, and particularly to components having integrally connected portions resistive to moisture, decay and insects.

BACKGROUND OF THE INVENTION

The construction industry is under constant pressure to provide quality products at low cost. Door frames and other construction components are no exception.

During construction of a home or the like, an opening is left in the wall in which the door or window is installed. In some cases, a custom door frame is built in the door opening. After the door frame is built, the door is hung within the door frame. While this provides builders complete control, such a construction technique can be time consuming and costly. Measurements and construction must be very precise to accurately place the door frame into the opening and account for small variations in the door.

Another method of hanging frames is with the use of pre-hung doors or windows. In this case, a completed frame and door is provided to the builder. An example of an adjustable door frame assembly is found in U.S. Pat. No. 3,812,621. Thus, the frame and door are pre-matched for tighter fitting door or windows.

One known method of providing pre-built frames at a low cost is with the use of scrap lumber. Scrap lumber is produced when a defect, such as a knot hole or imperfect edge, is removed from a larger or parent piece of lumber. This allows the parent lumber to be sold as a higher quality piece than it otherwise would. The resulting scrap piece containing the defect is typically much smaller than its parent piece. The scrap lumber is then processed or recycled by removing the defect to produce a relatively small, but still good quality piece of wood fiber. These small pieces are then finger jointed at their ends and joined end to end to produce a single long piece, which is used to produce the door frame.

Norlander in U.S. Pat. No. 5,074,092 describes a technique for overcoming certain deficiencies with inexpensive lumber having a variety of knots and other defects. Quality veneers are assembled with cores of short end-to-end staves of solid lumber to produce a laminated wood door product having stability and good appearance.

While these techniques have produced low cost door and window frames, the use of wood in them causes the frames to be susceptible to moisture and insects. In the past, once water or termite damage has caused a portion of the frame to decay, that portion of the frame was replaced. Repair was performed while the frame was in place. A craftsman would cut out the decayed portion and replace it with another wood or plastic section. Thus, while costs were initially low, the end result was often expensive.

SUMMARY OF THE INVENTION

The present invention is a component having durable, yet cost effective characteristics not found in the prior art. In the preferred embodiment, a construction component is comprised of a first section and second section. The second section is comprised of a material that is durable and moisture, decay and insect resistant. The first section is comprised of wood. The wood and durable portions are connected end to end with a glued finger joint or other mechanical connection to assemble the component. Associated hardware may also be added.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF PREFERRED EMBODIMENT

Figure 1:
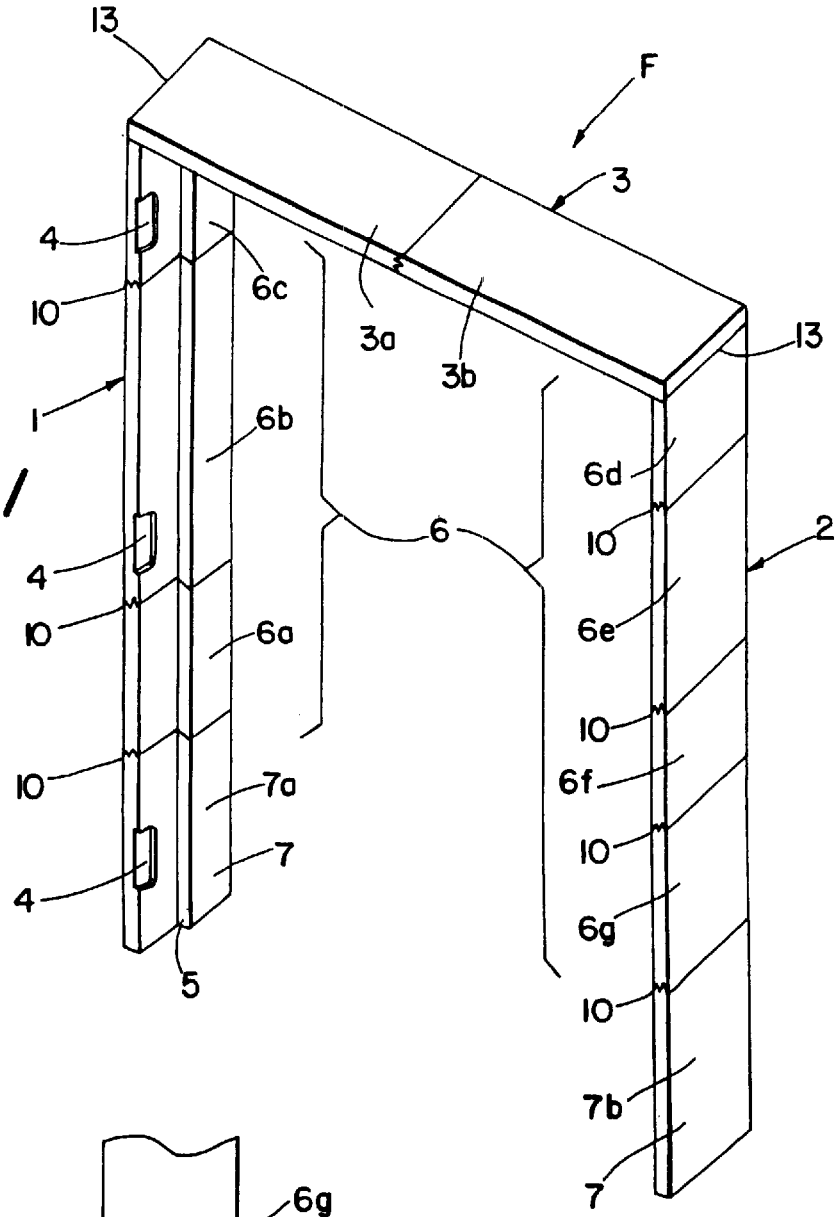
FIG. 1 is an isometric view of a door frame system according to a preferred embodiment of the present invention.

Referring now to FIG. 1, there is illustrated a door frame F embodying the principles of the present invention. The door frame F is comprised of spaced vertical side jambs 1 and 2 connected together at the top by a horizontal top jamb 3. One side jamb 1 includes a suitable number of hinge recesses 4 formed in it to mount hinges on while the opposite side jamb 2 is used to mount a strike plate. Each of the jambs 1, 2 and 3 have an L-shaped shoulder 5 on an interior surface for capturing a door.

Each of the side jambs 1 and 2 are formed from an upper wood portion 6 and a lower durable portion 7. The wood portions 6 are formed from a number of smaller wood pieces 6*a*–6*g*. Side jamb 1 includes wood pieces 6*a*, 6*b* and 6*c* and side jamb 2 includes wood pieces 6*d*, 6*e*, 6*f* and 6*g*. The wood pieces 6*a*–6*g* are formed from what originally were pieces of scrap lumber which have been processed or recycled to remove imperfections, such as knots, bark or uneven surfaces. As shown, the wood pieces 6*a*–6*g* are not necessarily of even length and the side jambs 1 and 2 may comparatively include an unequal number or wood pieces. However, the number of pieces 6*a*–6*g* is not so many as to jeopardize overall strength of the frame F.

Top jamb 3 is formed from a number of smaller wood pieces 3*a* and 3*b* in a manner similar to wood portion 6.

The durable portion 7 may be an extruded wood-based product, such as Strandex®, ERT®, TREX® or the like, which can be shaped using conventional wood processing techniques, painted or stained. The durable portion may also be made of plastic, vinyl, metal, and combinations of any of these materials. The durable portion 7 has the characteristics of being moisture, decay and insect resistant. Side jamb 1 includes a durable piece 7*a* and side jamb 2 includes a durable piece 7*b*. The placement of the durable portion 7. on the lower portion of the frame prevents all but the most severe weather and insect damage suffered by prior art door frames. The durable pieces 7*a* and 7*b* may be proportioned based on the expected exposure to adverse conditions such as rain, snow or insects. Thus, the assembly of the wood portion 6 and the durable portion 7 provides a durable, yet cost effective door frame. It is noted that other materials, such as plastic or similar extrusions, can be used for the durable pieces to achieve the principles of the present invention.

Figure 2:
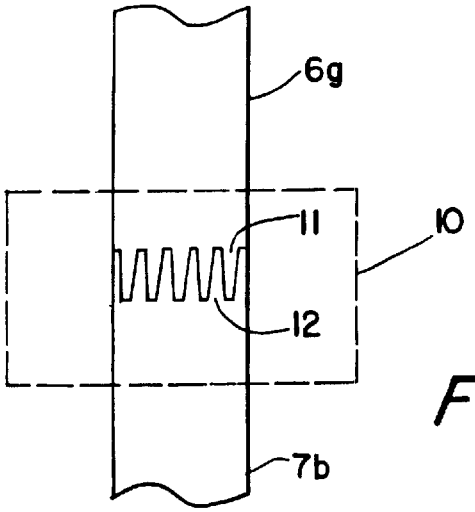
FIG. 2 is a side view of a side portion of the door frame of FIG. 1.

In the assembly of the side jambs 1 and 2, the durable pieces 7 are preferably connected end to end by a glued finger joint 10 to the wood portions 6. One of the joints 10 is illustrated more clearly in FIG. 2. Referring now to FIG. 2, wood piece 6*g* includes a number of fingers 11 protruding from an end face and durable piece 7*b* has a corresponding number of mated fingers 12 protruding from an adjacent end face. It should be understood that other wood joints are contemplated, such as edge gluing or their equivalents.

Referring back to FIG. 1, it is there illustrated that the wood pieces comprising the wood portion 6 are also finger jointed so that the assembly of the wood portion 6 with the durable portion 7 forms a complete side jamb 1 or 2.

In the assembly of the door frame F, the top jamb 3 is connected to the side jambs 1 and 2 with a corner joint 13. After assembly of the door frame F, the door frame F is ready for placement into a door opening of a wall. Thereafter, hinges may be attached at recesses 4 to the door frame F and a strike plate added to mount and receive a door. In use, the moisture, decay and insect resistant features of the door frame F prevent the problems associated with the prior art door frames.

Figure 3:
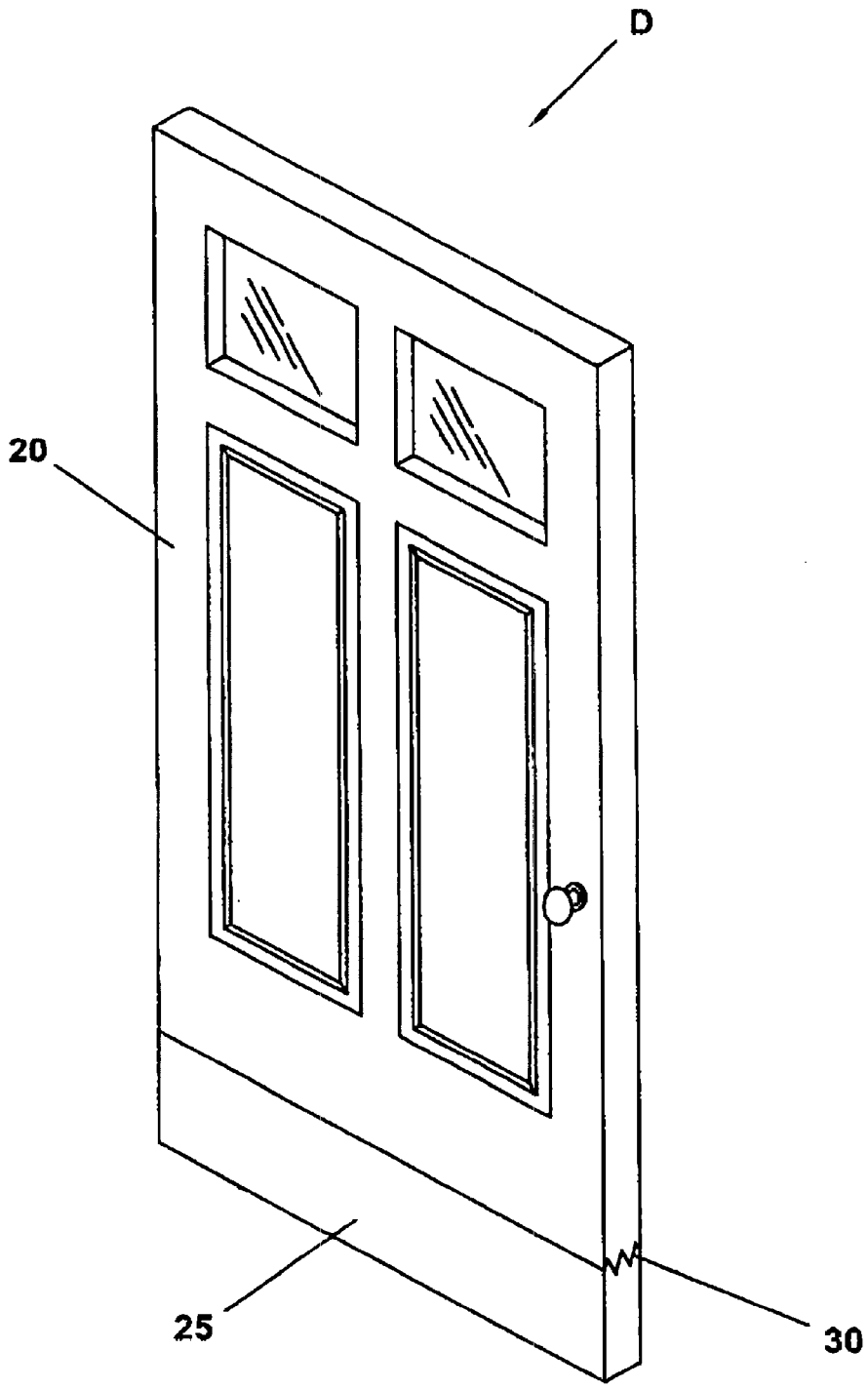
FIG. 3 is an isometric view of a door according to an alternate embodiment of the present invention.

An alternate embodiment of the principles of the present invention can be seen by reference to the door D illustrated in FIG. 3. The door D is partially comprised of a top portion 20, which, in this embodiment, consists of wood. The top portion 20 may be constructed using a number of small pieces of wood, as was discussed above with respect to a door jamb. Alternatively, the top portion 20 may be constructed using more conventional door construction techniques, which techniques are well known in the art and need not be described in detail here. The door D also has a lower, durable portion 25 that may consist of an extruded wood-based product, such as Strandex®, ERT®, TREX®, TIMBERTECH® or the like, which can be shaped using conventional wood processing techniques, and painted or stained to conform to the appearance of the upper portion. The durable portion 25 may also be made of plastic, vinyl, metal, and combinations of any of these materials. As can be seen, the durable portion 25 may be attached to the top portion 20 using a glued finger joint 30, for example which can be observed in more detail by reference to FIG. 2. The durable portion 25 may have the characteristics of being moisture, decay and/or insect resistant. The placement of the durable portion 25 on the lower portion of the door D prevents or retards all but the most severe weather and insect damage typically suffered by known doors. The durable portion 25 may be proportioned based on the expected exposure to adverse conditions such as rain, snow or insects. Thus, the assembly of the wood (top) portion 20 and the durable portion 25 provides a durable, yet cost effective door.

It is noted that the use of the present invention is not limited to door frames. The invention may be used in window frames, garage door frames, porch posts, casings, brickmolds and other applications where wood is heavily subjected to weather or insects, but a cost effective solution is desired. Further, it is noted that solid stock lumber can be used in place of pieces 6*a*–6*g* without detracting from the principles of the present invention. It is also noted that further weather and insect protection can be afforded by chemically treating the wood pieces, although at a somewhat higher cost.

In describing the invention, reference has been made to a preferred embodiment and illustrative advantages of the invention. However, those skilled in the art and familiar with the disclosure of the present invention may recognize additions, deletions, modifications, substitutions, equivalents and other changes may be made without departing from the spirit of the invention.

What is claimed is:

1. An apparatus comprising:

a door having an upper portion and a lower portion secured together, said upper portion consisting of wood, said lower portion consisting of a blend of wood particles and thermoplastic material.

2. An apparatus comprising:

a door having an upper portion and a lower portion secured together, said upper portion consisting of wood, said lower portion consisting of a durable wood having greater weathering characteristics than said wood forming said upper portion.

3. An apparatus comprising:

a construction component having an upper portion and a lower portion secured together to comprise a door frame, said upper portion includes a first material, said lower portion includes a durable material made from at least one material different from said upper portion.

4. An apparatus comprising:

a construction component having an upper portion and a lower portion secured together to comprise a door, said upper portion includes a first material, said lower portion includes a durable material made from a durable wood having greater weathering characteristics than said first material.

* * * * *